US007121887B2

(12) United States Patent
Zhang et al.

(10) Patent No.: US 7,121,887 B2
(45) Date of Patent: Oct. 17, 2006

(54) ELECTRICAL CONNECTOR WITH SHIELDING SHELL

(75) Inventors: An-Yi Zhang, Kunsan (CN); Chun-Sheng Li, Kunsan (CN); Ran Chen, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/169,023

(22) Filed: Jun. 27, 2005

(65) Prior Publication Data

US 2006/0128219 A1 Jun. 15, 2006

(30) Foreign Application Priority Data

Dec. 15, 2004 (CN) ..... 2004 2 0054516

(51) Int. Cl.
*H01R 13/648* (2006.01)

(52) U.S. Cl. ..... 439/607

(58) Field of Classification Search ..... 439/607, 439/609, 610

See application file for complete search history.

(56) References Cited

U.S. PATENT DOCUMENTS

| | | | | |
|---|---|---|---|---|
| 6,319,026 | B1 * | 11/2001 | Chen et al. | 439/108 |
| 6,354,875 | B1 * | 3/2002 | Wu | 439/607 |
| D471,872 | S | 3/2003 | Kawase | |
| 2004/0043659 | A1 * | 3/2004 | Lai | 439/607 |

* cited by examiner

*Primary Examiner*—Ross Gushi
(74) *Attorney, Agent, or Firm*—Wei Te Chung

(57) ABSTRACT

An electrical connector including an insulative housing (10) comprising a longitudinal base (110), a pair of shoulder portions (130) respectively projecting forwards from two opposite end sections of the longitudinal base, and a tongue plate (120) projecting forwards from a middle section of the longitudinal base and located between the pair of shoulder portions; a plurality of terminals (30) arranged on the tongue plate; and a shell (20) provided with a rectangle frame surrounding the tongue plate and defining a mating opening therein for accommodating a mating portion of a mating connector, the rectangle frame fitly set between the shoulder portions.

17 Claims, 4 Drawing Sheets

ELECTRICAL CONNECTOR WITH SHIELDING SHELL

BACKGROUND OF THE INVENTION

1. Field of the Invention

The present invention relates to an electrical connector, and more particularly to an electrical connector having a shielding shell.

2. Description of Related Art

U.S. Pat. No. D471,872 discloses a conventional connector comprising an insulative housing, a plurality of electrical terminals, and a metal shell. The housing includes a tongue plate on which the electrical terminals are arranged and a circuit of side walls surrounding the tongue plate and defining a rectangle mating opening for receiving a mating portion of a mating connector. The shell is of a two-double structure respectively attached to inner surfaces and outer surfaces of the side walls. However, as the mating opening is provided by the side walls of the housing together with the shell attached thereon, it increases the size of connector and thus does not meet the minimizing request for some kind of connectors. Otherwise, the complicated structure of the two-double shell increases manufacturing difficulty of the connectors and thus increases manufacturing cost of the connectors.

Therefore, a new connector is desired to overcome above-mentioned problems.

SUMMARY OF THE INVENTION

An object of the present invention is to provide an electrical connector minimized in size.

In order to achieve above-mentioned object, an electrical connector of the present invention includes an insulative housing comprising a longitudinal base, a pair of shoulder portions respectively projecting forwards from two opposite end sections of the longitudinal base, and a tongue plate projecting forwards from a middle section of the longitudinal base and located between the pair of shoulder portions; a plurality of terminals arranged on the tongue plate; and a shell provided with a rectangle frame surrounding the tongue plate and defining a mating opening therein for accommodating a mating portion of a mating connector, the rectangle frame fitly set between the shoulder portions.

Other objects, advantages and novel features of the present invention will become more apparent from the following detailed description of the present embodiment when taken in conjunction with the accompanying drawings.

DETAILED DESCRIPTION OF THE INVENTION

Figure 1:
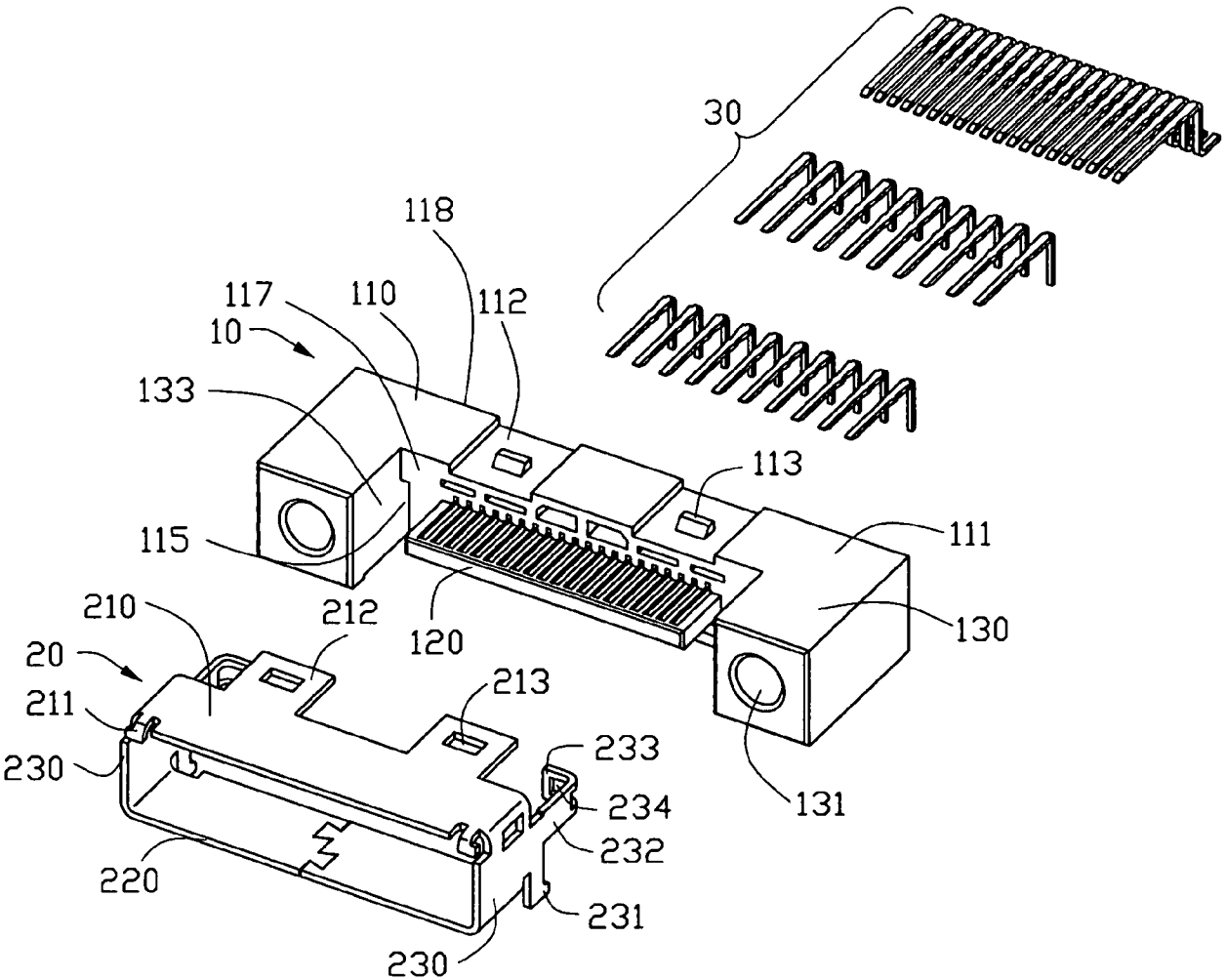
FIG. 1 is an exploded perspective view of an electrical connector in accordance with the preferred embodiment of the present invention.

Reference will now be made to the drawing figures to describe the preferred embodiment of the present invention in detail.

Figure 2:
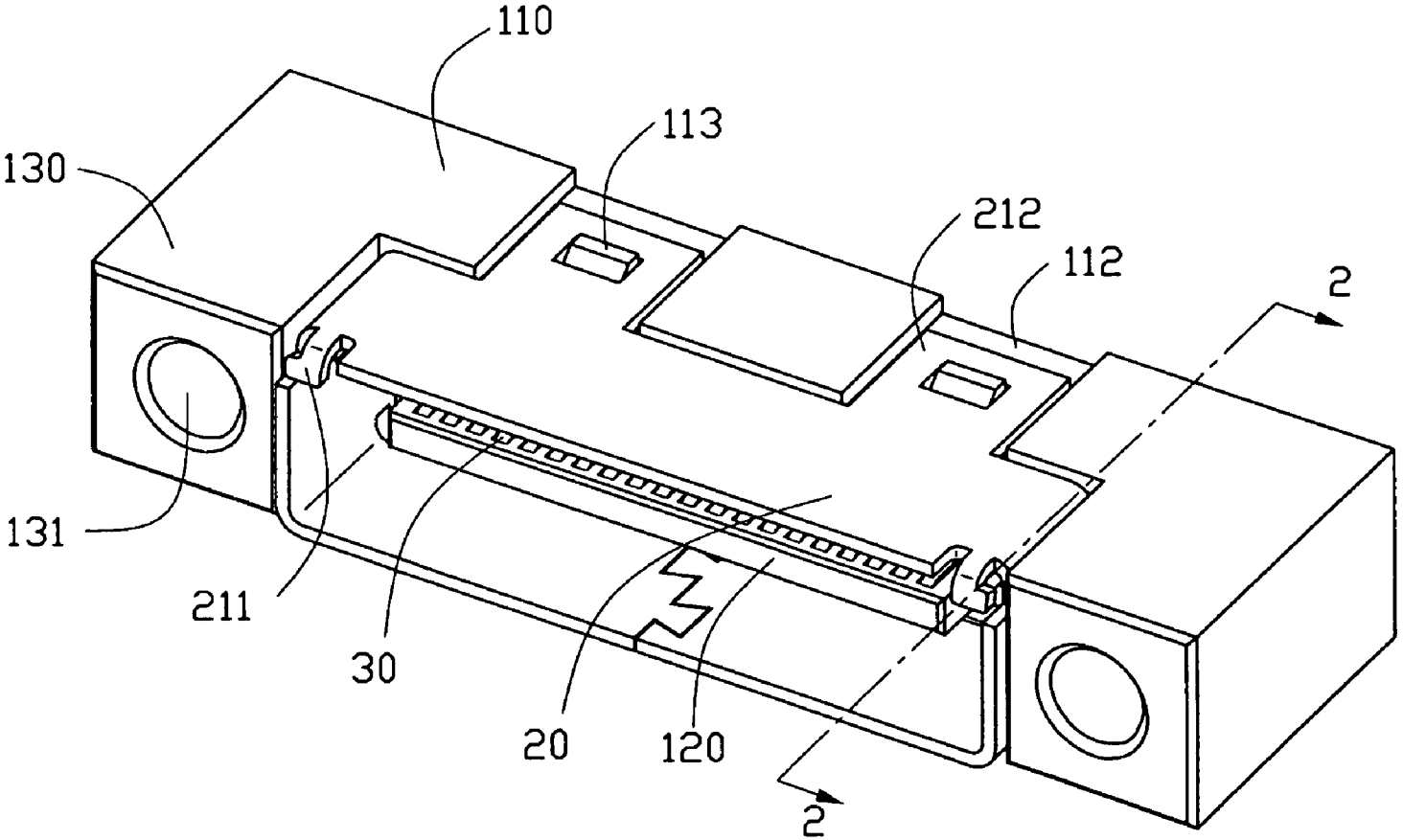
FIG. 2 is an assembled perspective view of the electrical connector of FIG. 1.

Referring to FIGS. 1 and 2, an electrical connector in accordance with the present invention includes a housing 10, a shell 20, and a plurality of terminals 30. The housing 10 is made from insulative material and the shell 20 and the terminals 30 are made from conductive material, such as metal.

The housing 10 comprises a longitudinal base 110, a tongue plate 120 projecting forwards from a middle section of the longitudinal base 110, and a pair of shoulder portions 130 respectively projecting forwards from two end sections of the longitudinal base 110 and thus respectively located at two ends of the tongue plate 120 and spaced from the tongue plate 120. The tongue plate 120 defines a plurality of channels on its two opposite mating surfaces for accommodating the terminals 30. Each of the shoulder portions 130 is formed with a guiding hole 131 therein for guiding and receiving an aligning post of a mating connector (not shown). The base 110 defines a pair of shallow recesses 112 on its upper face 111, wherein each recess 112 has a tuber 113 therein for engaging with corresponding slot of the shell 20 to lock the shell 20 on the housing 10, which will detailedly described hereafter.

Figure 3:
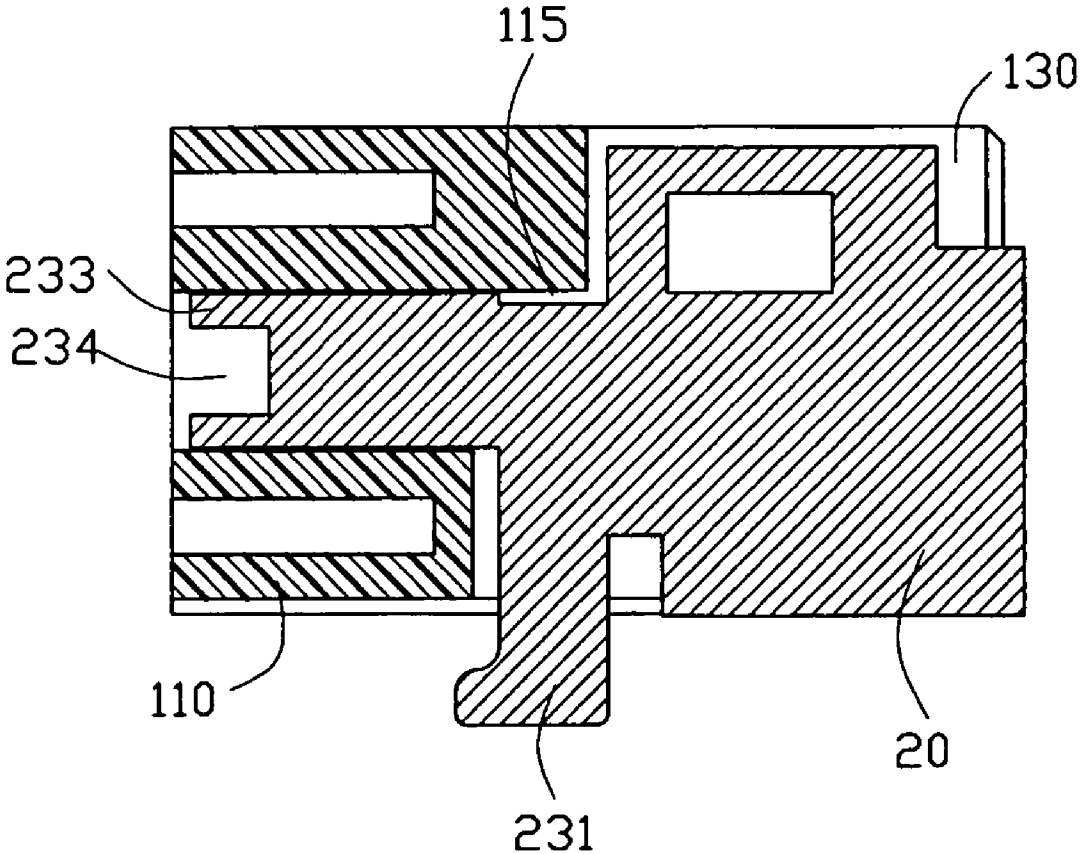
FIG. 3 is a cross-sectional view taken along the line 2—2 in FIG. 2.
Figure 4:
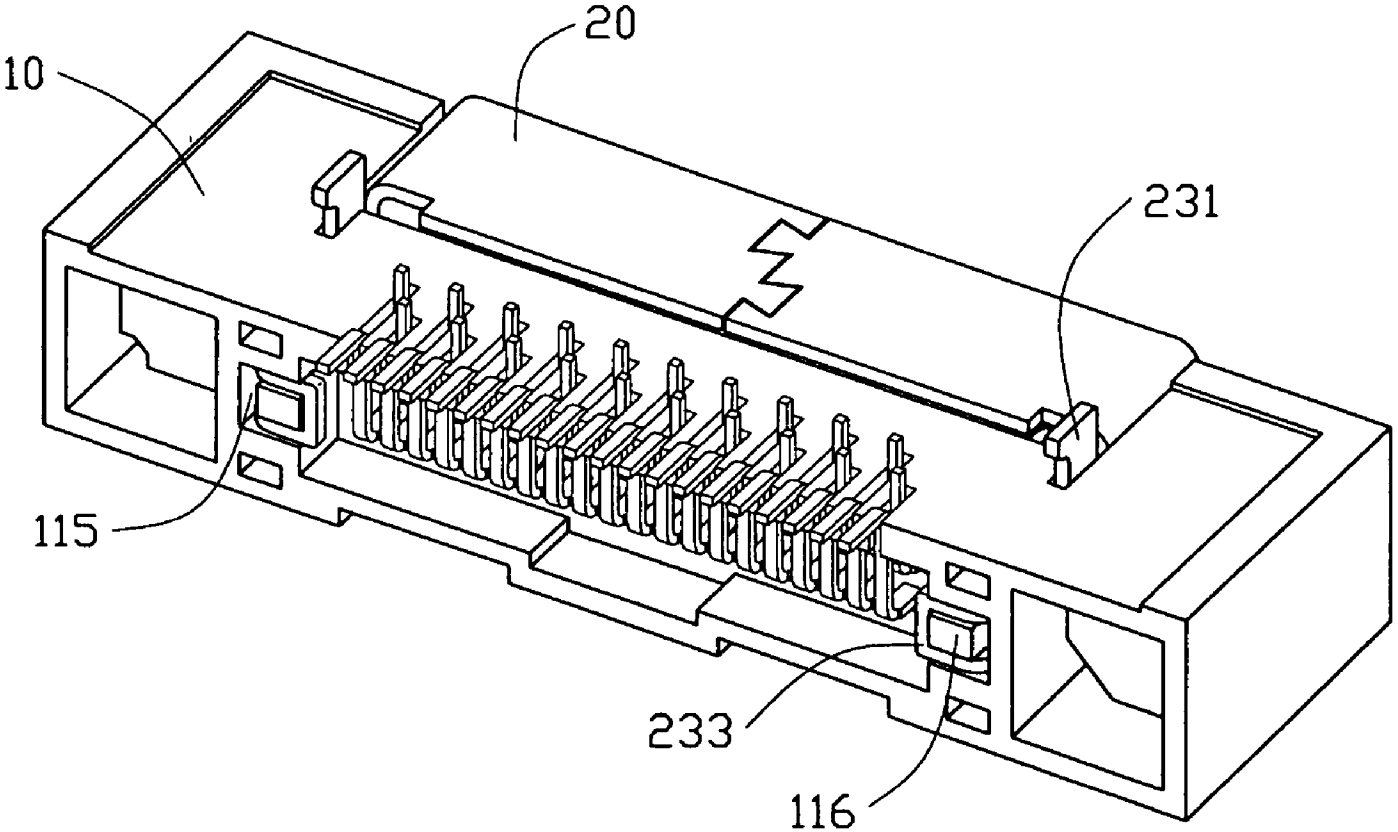
FIG. 4 is another assembled perspective view of the electrical connector of FIG. 1 taken from another aspect.

The shell 20 is of a close frame structure formed by joining a metal strip end to end with a swallowtail joint. The frame structure shell 20 comprises an upper wall 210, a lower wall 220 and a pair of side walls 230, and defines a rectangle hole therebetween. There is a pair of ears 212 extending backwards from the upper wall 210 to be respectively received in the shallow recesses 112 of the housing 10 which is of a deepness corresponding to the thickness of the ears 212. Each of the ears 212 defines a through slot for engaging with the tuber 113 in the shallow recess 112. In assembly, the shell 20 is fitly set between the two shoulder portions 130 with its front fringe flush with front surfaces of the shoulder portions 130, as best shown in FIG. 2. To be soundly retained on the housing 10, the shell 20 further has a pair of retaining arms 232 respectively extending backwards from the side walls 230 to be inserted into an aperture 115 defined through the base 110 from its front face 117 to its rear face 118 along the inner surface 133 of the shoulder portion 130, as best shown in FIG. 3. Each of the retaining arms 232 has a bendable free end 233 defining a through slot 234 therein. In the beginning, the retaining arm 232 is of an unbent shape, not as shown in FIG. 1, in which the bendable free end 233 thereof has been bent. Until the retaining arm 232 completely inserted into the through aperture 115, the bendable free end 233 thereof which has went through the through aperture 115 will be bent inwards to make the through slot 234 be hooked on to a button 116 formed at a rear face 118 of the base 110, as best shown in FIG. 4. The shell 20 further has a pair of solder legs 231 respectively extending down from the side walls 230 adjacent to a rear fringe thereof to be soldered to a printed circuit board.

In assembly, the frame structure shell 20 enclosing the tongue plate 120 singly functions as a mating section of the connector and the rectangle hole defined by the frame structure shell 20 functions as a mating opening of the connector for receiving a mating portion of the mating connector. Thus it makes the connector have a minimized size by contrast with connectors in which mating sections are formed by housing surrounded with a shell. Otherwise, for preventing the mating connector from mismating with the connector, the shell 20 has a pair of anti-mismating tabs 211 extending from corners respectively formed by the upper wall 210 and the two side walls 230 and bent inwards the mating opening.

However, the disclosure is illustrative only, changes may be made in detail, especially in matter of shape, size, and arrangement of parts within the principles of the invention.

What is claimed is:

1. An electrical connector comprising:

an insulative housing including a longitudinal base, a pair of shoulder portions respectively projecting forwards from two opposite end sections of the longitudinal base, and a tongue plate projecting forwards from a middle section of the longitudinal base and located between the pair of shoulder portions;

a plurality of terminals arranged on the tongue plate; and a shell provided with a rectangle frame surrounding the tongue plate and defining a mating opening therein for accommodating a mating portion of a mating connector, the rectangle frame fitly set between the shoulder portions, wherein the rectangle frame has a front fringe substantially flush with front surfaces of the shoulder portions.

2. The electrical connector as claimed in claim 1, wherein the shoulder portion defines a guiding hole adapt for guiding and receiving an aligning post of the mating connector.

3. The electrical connector as claimed in claim 1, the rectangle frame is formed from a metal strip joined end to end with a swallowtail joint.

4. The electrical connector as claimed in claim 1, wherein the shell has a pair of solder legs adapted for being soldered onto a printed circuit board.

5. The electrical connector as claimed in claim 1, wherein the base has an upper face defining a recess with a tuber therein, and the shell has a retaining ear extending rearwards received in the recess and defining a through slot for engaging with the tuber.

6. The electrical connector as claimed in claim 1, wherein the rectangle frame has anti-mismating mechanism formed at front edge thereof.

7. The electrical connector as claimed in claim 6, wherein the anti-mismating mechanism includes a tab extending from a corner of the rectangle frame and bent inwards to the mating opening.

8. The electrical connector as claimed in claim 1, wherein the shell has a pair of retaining arms retained in the base of the housing.

9. The electrical connector as claimed in claim 8, wherein the retaining arm extends rearwards throughout the base and has a free end extending beyond a rear face of the base and bendable to hook on to a button formed at the rear face of the base.

10. An electrical connector comprising:

an insulative housing defining a thick section and a thin section, said thick section including an elongated base and a pair of shoulder portions respectively projecting forward from two opposite end sections of the base, said base and said pair of shoulder portions commonly defining a U-shaped configuration, the thin section including a tongue plate projecting forwardly from the base and located between said pair of shoulder portions along a longitudinal direction of said housing;

a plurality of terminals disposed in the housing with contact portions exposed upon the tongue plate; and a metallic shield covering said tongue plate but not the shoulder portions; wherein said shield defines a mating cavity for accommodating a complementary connector therein, wherein said shield defines a vertical dimension similar to a vertical dimension of said thick section therefore top and bottom surfaces of the shield along the vertical direction substantially flush with top and bottom surfaces of the shoulder portions, respectively.

11. The electrical connector as claimed in claim 10, wherein said shield defines a lengthwise dimension similar to that between the pair of shoulder portions along said longitudinal direction.

12. The electrical connector as claimed in claim 10, wherein said shield pair of shoulder portion define holes extending in a mating direction.

13. An electrical connector comprising:

an insulative housing including an elongated base and a pair of shoulder portions respectively projecting forward from two opposite end sections of the base, said base and said pair of shoulder portions commonly defining a U-shaped configuration, a mating section projecting forwardly from the base and located between said pair of shoulder portions along a longitudinal direction of said housing;

a plurality of terminals disposed in the housing with contact portions exposed upon the mating section; and a metallic shield sandwiched between the shoulder portions; wherein said shield cooperates with said mating section to couple to a mating port of a complementary connector therein, and has anti-mismating mechanism formed at a front edge thereof.

14. The electrical connector as claimed in claim 13, wherein said shield defines a configuration snugly received in said U-shaped configuration.

15. The electrical connector as claimed in claim 13, wherein said pair of shoulder portions define holes extending along a mating direction.

16. The electrical connector as claimed in claim 13, wherein said mating section includes a tongue plate.

17. The electrical connector as claimed in claim 13, wherein the anti-mismating mechanism includes a tab extending from a corner of the metallic shield and bent inwards to the mating port.

* * * * *